US007912391B2

(12) United States Patent
Kimura et al.

(10) Patent No.: US 7,912,391 B2
(45) Date of Patent: Mar. 22, 2011

(54) IMAGE-HEATING DEVICE WITH A FIRST HEATING MEMBER AND AN ADJUSTABLE SECOND HEATING MEMBER

(75) Inventors: Kuniyasu Kimura, Toride (JP); Naoto Watanabe, Kashiwa (JP); Yukio Yokoyama, Sakado (JP); Hiroto Nishihara, Toride (JP); Takako Hanada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/390,438

(22) Filed: Mar. 28, 2006

(65) Prior Publication Data

US 2007/0086803 A1 Apr. 19, 2007

(30) Foreign Application Priority Data

Apr. 1, 2005 (JP) ..... 2005-106352

(51) Int. Cl.
*G03G 15/20* (2006.01)

(52) U.S. Cl. ..... 399/69; 399/322; 399/328; 399/330; 399/331; 399/400; 399/407; 219/216

(58) Field of Classification Search ..... 399/33, 399/322, 328, 400, 411, 406–407, 67–69, 399/330–331; 219/216
See application file for complete search history.

(56) References Cited

U.S. PATENT DOCUMENTS

| | | | | |
|---|---|---|---|---|
| 6,243,559 | B1 * | 6/2001 | Kurotaka et al. | 399/329 |
| 6,512,914 | B2 | 1/2003 | Kabashima | |
| 6,535,712 | B2 * | 3/2003 | Richards | 399/341 |
| 6,795,661 | B2 * | 9/2004 | Kanesawa et al. | 399/69 |
| 6,898,388 | B2 * | 5/2005 | Uehara et al. | 399/69 |
| 7,283,762 | B2 * | 10/2007 | Roof | 399/67 |
| 7,324,779 | B2 * | 1/2008 | Anderson et al. | 399/341 |
| 7,336,920 | B2 * | 2/2008 | Anderson et al. | 399/341 |
| 7,412,180 | B2 * | 8/2008 | Roof | 399/67 |
| 7,433,627 | B2 * | 10/2008 | German et al. | 399/102 |
| 7,587,151 | B2 * | 9/2009 | Hanada et al. | 399/67 |
| 7,609,983 | B2 * | 10/2009 | Kinoshita et al. | 399/19 |
| 7,657,200 | B2 * | 2/2010 | Nogami | 399/68 |
| 7,672,634 | B2 * | 3/2010 | Lofthus et al. | 399/341 |
| 7,697,859 | B2 * | 4/2010 | Mori et al. | 399/69 |
| 7,720,419 | B2 * | 5/2010 | Omata | 399/320 |
| 2005/0031364 | A1 * | 2/2005 | Hayashi | 399/69 |
| 2005/0158089 | A1 * | 7/2005 | Amarakoon | 399/341 |

(Continued)

FOREIGN PATENT DOCUMENTS

| | | |
|---|---|---|
| JP | 8-227194 | 9/1996 |

(Continued)

OTHER PUBLICATIONS

English translation of JPO Pub # 2002-214948.* English translation of JPO Pub # 2002-091211.*

*Primary Examiner* — David M Gray
*Assistant Examiner* — Geoffrey T Evans
(74) *Attorney, Agent, or Firm* — Fitzpatrick, Cella, Harper & Scinto

(57) ABSTRACT

An image-heating device has a detector for detecting the state of a recording medium at a position between a first fixing unit and a second fixing unit along a conveying path of the recording medium and a controller for controlling a fixing condition of the second fixing unit on the basis of the information obtained by the detector.

8 Claims, 10 Drawing Sheets

U.S. PATENT DOCUMENTS

| | | | | |
|---|---|---|---|---|
| 2005/0219653 | A1* | 10/2005 | Maebashi et al. | 358/488 |
| 2005/0276624 | A1* | 12/2005 | Fujino | 399/69 |
| 2008/0012927 | A1* | 1/2008 | Kimura et al. | 347/179 |
| 2010/0189447 | A1* | 7/2010 | Ishizuka et al. | 399/15 |
| 2010/0221048 | A1* | 9/2010 | Shiozawa et al. | 399/328 |

FOREIGN PATENT DOCUMENTS

| | | |
|---|---|---|
| JP | 9-190111 | 7/1997 |
| JP | 2002-91211 | 3/2002 |
| JP | 2002-214948 | 7/2002 |

* cited by examiner

FIG. 5

| KIND OF RECORDING MEDIUM | GLOSSINESS (REFLECTANCE) | FIRST FIXING TEMPERATURE | SECOND FIXING TEMPERATURE |
|---|---|---|---|
| NORMAL PAPER | 10 | 170 | 180 |
| | 15 | 175 | 180 |
| | 20 | 180 | 180 |
| | 25 | 185 | 180 |
| | 30 | 185 | 180 |
| CARDBOARD PAPER | 10 | 180 | 200 |
| | 15 | 190 | 200 |
| | 20 | 200 | 200 |
| | 25 | 205 | 200 |
| | 30 | 210 | 200 |
| GLOSSY PAPER | 10 | 185 | 190 |
| | 15 | 185 | 190 |
| | 20 | 190 | 190 |
| | 25 | 190 | 190 |
| | 30 | 190 | 190 |
| | [%] | [°C] | [°C] |

IMAGE-HEATING DEVICE WITH A FIRST HEATING MEMBER AND AN ADJUSTABLE SECOND HEATING MEMBER

BACKGROUND OF THE INVENTION

1. Field of the Invention

The present invention relates to image-heating devices for heating images formed on recording media in image-forming apparatuses using electrophotography or the like.

More particularly, the present invention relates to an image-heating device having a plurality of image-heating units in tandem for heating an image formed on a recording medium, wherein the recording medium is caused to pass through an image-heating unit positioned upstream in a conveying direction of the recording medium and then through an image-heating unit positioned downstream in the conveying direction of the recording medium.

2. Description of the Related Art

In known electrophotographic technology, an electrostatic latent image formed on a photosensitive drum that functions as an image carrier is developed with toner, and then the thus obtained toner image is transferred onto a recording medium, such as a piece of paper or an overhead projector (OHP) sheet, directly or using an intermediate transferring member. Then, the image is fixed on the recording medium by applying heat and pressure with a fixing unit.

Recently, electrophotographic image-forming apparatuses have come into common use in place of printing apparatuses. Accordingly, image-forming apparatuses including a plurality of image-heating units to output an image with a large glossiness range at a high speed have been suggested in, for example, Japanese Patent Laid-Open No. 2002-214948.

In known apparatuses including only one fixing unit, the glossiness range of the output image is small since there is a limit to the amount of heat that can be applied to the recording medium to melt the toner. In addition, since the amount of heat required differs depending on the type of recording medium, highly glossy images cannot be formed on a recording medium that requires a large amount of heat. In comparison, when a first fixing unit and a second fixing unit are provided at upstream and downstream positions, respectively, and settings of image-heating units included in the first and second fixing units are variable, the range of heat that can be applied to the recording medium is increased. Accordingly, the glossiness range of the output image can be increased.

On the other hand, Japanese Patent Laid-Open Nos. 8-227194, 9-190111, and 2002-091211 disclose structures including a single image-heating unit. In these structures, the glossiness of an image output from the image-heating unit is detected, and then the settings of the image-heating unit are adjusted such that the detected glossiness approaches a desired glossiness. Accordingly, the quality of the output image is improved.

Similarly, in the above-described structures including a plurality of image-heating units, the quality of the output image can be improved by detecting the glossiness of the image that is finally output after being heated by the plurality of image-heating units and adjusting the settings of one of the image-heating units.

However, when the glossiness of the image is detected after the image passes through all of the image-heating units and is finally output, a relatively long time is required to adjust the settings of the image-heating units since it takes a longer time for the image to be finally output after passing through all of the image-heating units, as compared to an image-forming apparatus with only a single image-heating unit. Accordingly, there is a demand to perform the adjustment at an intermediate position before the image is finally output.

SUMMARY OF THE INVENTION

At least one embodiment of the present invention is directed to an image-heating device that can perform an adjustment of an image by heat before the image is finally output.

According to an embodiment of the present invention, an image-heating device for heating an image on a recording medium includes first image-heating means for heating the recording medium, the first image heating means including a first image-heating member that heats the image on the recording medium and a first pressing member that is in pressure contact with the first image-heating member to form a first nip portion, the first image-heating means heating the image on the recording medium at the first nip portion between the first image-heating member and the first pressing member; second image-heating means for heating the recording medium, the second image heating means including a second image-heating member that heats the image on the recording medium by heat and a second pressing member that is in pressure contact with the second image-heating member to form a second nip portion, the second image-heating means positioned downstream of the first image heating means to heat the image on the recording medium at the second nip portion between the second image-heating member and the second pressing member after the image is heated by the first image-heating means; an image sensing member that senses the state of an image on the recording medium after the image is heated by the first image-heating means and before the image is heated by the second image-heating means; and changing means for changing an image-heating condition of the second image-heating means based on an output of the image sensing member.

Further features of the present invention will become apparent from the following description of exemplary embodiments with reference to the attached drawings.

BRIEF DESCRIPTION OF THE DRAWINGS

FIG. 5 is a table used for determining set temperatures of first and second fixing units.

DESCRIPTION OF THE EMBODIMENTS

First Embodiment

(1) Image-Forming Apparatus

Figure 1:
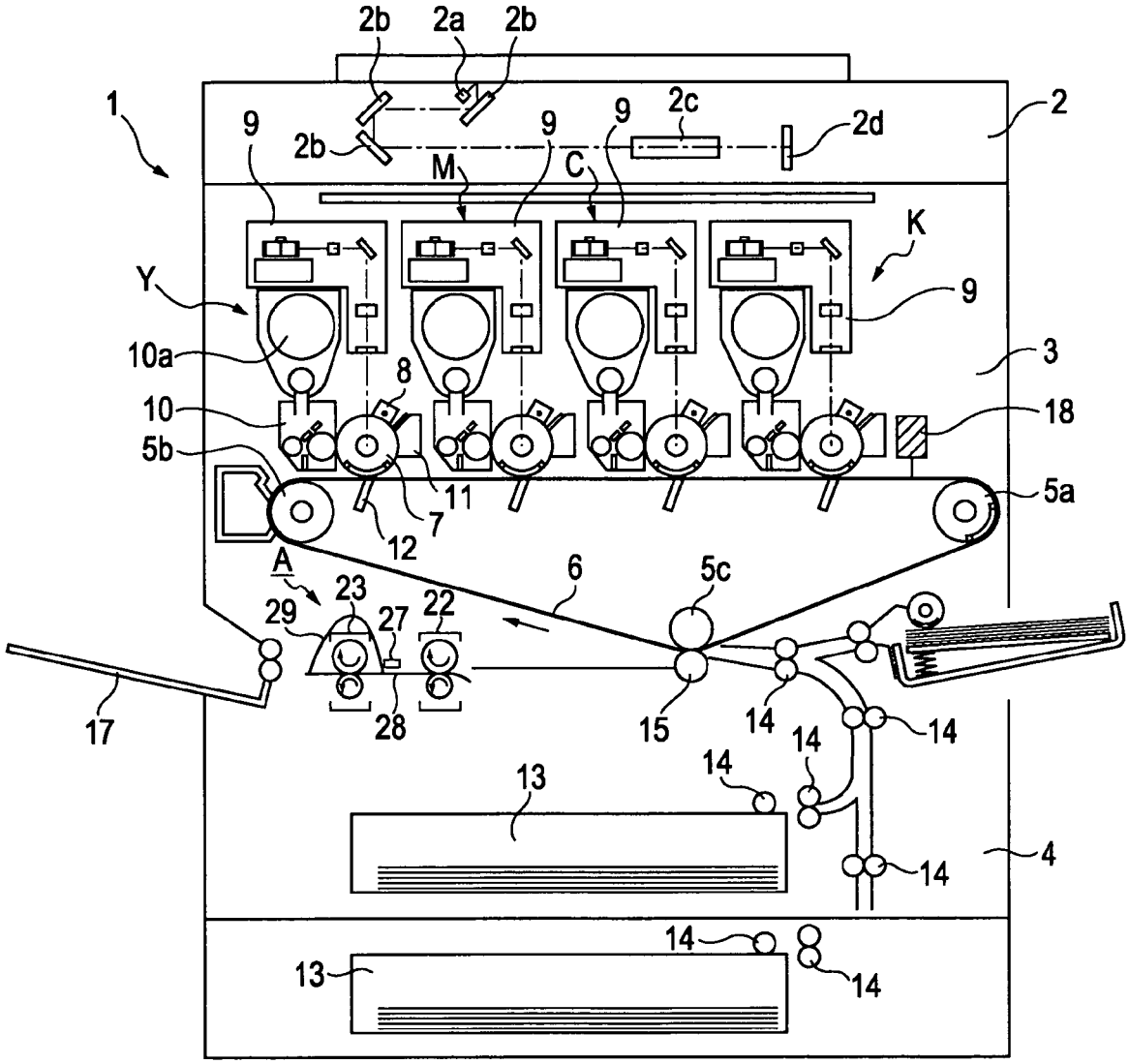
FIG. 1 illustrates a schematic diagram of an image-forming apparatus according to a first embodiment.

FIG. 1 illustrates a schematic diagram of an image-forming apparatus according to a first embodiment of the present invention and showing the overall structure of the image-forming apparatus.

First, the overall structure of the image-forming apparatus and an image-forming operation will be described below with reference to FIG. 1. FIG. 1 is a schematic sectional view illustrating the overall structure of the image-forming apparatus according to the first embodiment.

The image-forming apparatus according to the present invention includes a main body 1, an image-reading section 2 disposed at the top of the main body 1, an image-forming section 3 positioned below the image-reading section 2, and a recording-medium-conveying section 4 positioned below the image-forming section 3.

In the image-reading section 2, an original document placed on the top surface of the apparatus is irradiated with light emitted from a light source 2*a*, and light reflected by the original document is received by a line sensor 2*d* via mirrors 2*b* and a reading lens 2*c*. The light received by the line sensor 2*d* is converted into a digital signal and is transmitted to the image-forming section 3.

The image-forming section 3 includes four image-forming stations Y, M, C, and K arranged in parallel along a rotating direction of an intermediate transfer belt 6 that is stretched around a driving roller 5*a*, a driven roller 5*b*, and a transfer inner roller 5*c* and that rotates in the direction shown by the arrow. The image-forming stations respectively form yellow (Y), magenta (M), cyan (C), and black (K) toner images in that order in the rotating direction of the intermediate transfer belt 6. The structures of the four image-forming stations are identical, and only the colors of the toner images formed by the image-forming stations differ from each other.

The structure of the image-forming stations will be described below using the yellow image-forming station Y as an example. A photosensitive drum 7, which functions as an image carrier, is disposed so as to face the intermediate transfer belt 6. An electrifying unit 8, a scanning optical unit 9, a developing unit 10, and a cleaning unit 11 for removing the toner that remains on the photosensitive drum 7 are arranged around the photosensitive drum 7. The toner is supplied to the developing unit 10 by a toner-supplying member 10*a*.

In an image-forming operation, the electrifying unit 8 uniformly electrifies the surface of the photosensitive drum 7 as it rotates, and the photosensitive drum 7 is irradiated with light corresponding to image information that is emitted from the scanning optical unit 9. Accordingly, an electrostatic latent image is formed. The developing unit 10 visualizes the latent image by developing the latent image with toner, and the thus obtained toner image is transferred onto the rotating intermediate transfer belt 6 when a bias is applied to a primary transferring member 12.

Thereafter, yellow, magenta, cyan, and black toner images are successively transferred by a process similar to the above, and a color image is thereby formed on the intermediate transfer belt 6.

A recording medium is conveyed from the recording-medium-conveying section 4 to a secondary transfer unit in synchronization with the above-described image-forming operation. More specifically, the recording medium is conveyed from one of cassettes 13 mounted in a bottom section of the apparatus by conveying rollers 14. Then, the toner image on the intermediate transfer belt 6 is transferred onto the recording medium when a bias is applied to a secondary transfer outer roller 15 in the secondary transfer unit. After the toner image is transferred onto the recording medium, the recording medium is guided to a fixing device A that functions as an image-heating device and that has a tandem structure including first and second fixing units (image-heating means) 22 and 23. The recording medium successively passes through the first and second fixing units 22 and 23, where the unfixed toner image is subjected to heat-pressure fixing. The fixing device A will be described in more detail in section (2) below.

In FIG. 1, image-position sensors 18 are provided to detect the position information of the intermediate transfer belt 6. More specifically, three image-position sensors 18 are provided at back, middle, and front positions along the width of the intermediate transfer belt 6.

Before the image-forming apparatus performs the image-forming operation, a '+' mark (hereafter called a registration mark) is formed at a predetermined target position on the intermediate transfer belt 6 by each of the image-forming stations. Then, the positions of the registration marks formed by the image-forming stations are detected by the image-position sensors 18. Accordingly, a displacement of the image-forming position on the intermediate transfer belt 6 is detected for each of the image-forming stations, and automatic correction is performed by correcting means.

(2) Fixing Device A

Figure 2A:
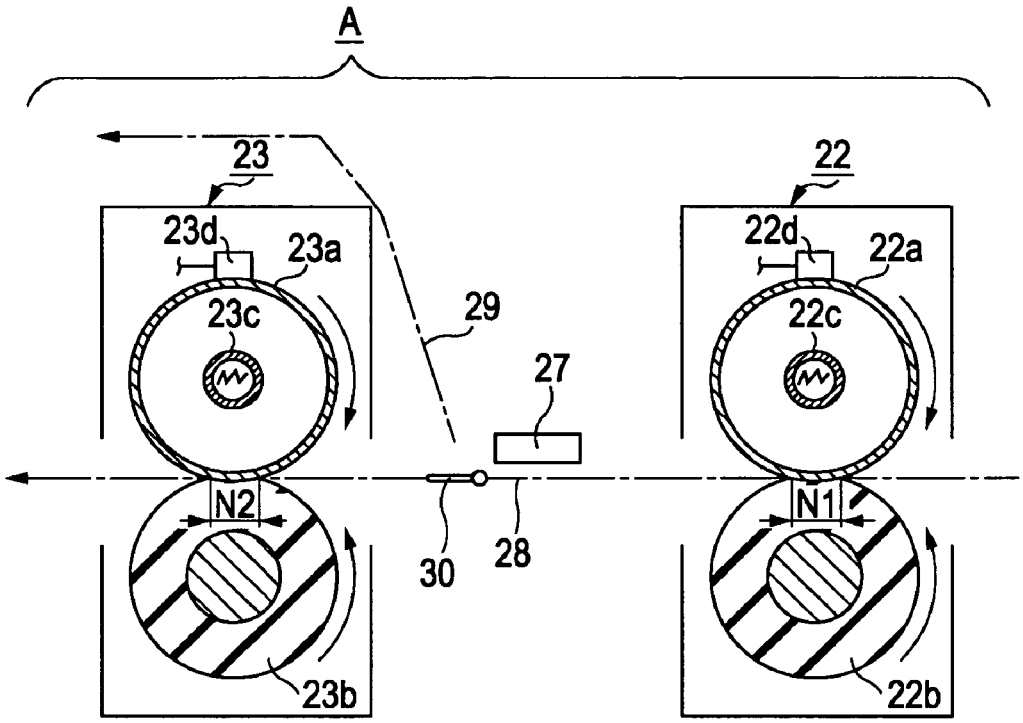
FIG. 2A illustrates an enlarged view of a fixing device having a tandem structure.

FIG. 2A illustrates an enlarged view of the fixing device A having a tandem structure including the first and second fixing units 22 and 23 arranged in series. The first fixing unit 22, which is positioned upstream in a conveying direction of the recording medium, functions as first image-heating means, and the second fixing unit 23, which is positioned downstream in the conveying direction of the recording medium, functions as second image-heating means. In the present embodiment, both the first and second fixing units 22 and 23 are of the heat roller type.

1) First Fixing Unit 22

The first fixing unit 22 includes a fixing roller (upper fixing roller) 22*a* that functions as a first image-heating member and a pressing roller (lower fixing roller) 22*b* that functions as a first pressing member.

The fixing roller 22*a* is obtained by, for example, forming an elastic layer of silicone rubber or the like around a cylindrical shaft made of Al or the like and covering the surface of the elastic layer with a release layer like a PFA tube. A fixing heater 22*c* including a halogen lamp or the like is disposed in the fixing roller 22*a*.

The pressing roller 22*b* is obtained by, for example, forming a silicone rubber layer around a shaft and covering the surface of the silicone rubber layer with a release layer like a PFA tube. The pressing roller 22*b* is pressed against the fixing roller 22*a* at a predetermined pressing force so as to form a fixing nip portion N1 with a predetermined width (dimension in the conveying direction of the recording medium).

The fixing roller 22*a* is rotated clockwise, as shown by the arrow in FIG. 2A, by a driving system (not shown) and the pressing roller 22*b* is rotated by the rotation of the fixing roller 22*a*. A thermistor 22*d*, which functions as a temperature sensor, is arranged so as to face the fixing roller 22*a*. The thermistor 22*d* is either in or out of contact with the fixing roller 22*a*. The fixing heater 22*c* receives electric power from a power supply unit (not shown) and accordingly the fixing roller 22*a* is heated by heat generated by the fixing heater 22*c*. The surface temperature of the fixing roller 22*a* is detected by the thermistor 22*d*, and the detected temperature information is fed back to a controller. The controller controls the electric power supplied to the fixing heater 22*c* from the power supply unit so that the surface-temperature information fed back from the thermistor 22*d* is adjusted at a predetermined fixing temperature, which is a target temperature.

2) Second Fixing Unit 23

The second fixing unit 23 includes a fixing roller 23*a* that functions as a second image-heating member and a pressing roller 23*b* that functions as a second pressing member.

The fixing roller 23*a* is obtained by, for example, forming an elastic layer of silicone rubber or the like around a cylindrical shaft made of Al or the like and covering the surface of the elastic layer with a release layer like a PFA tube. A fixing heater 23*c* including a halogen lamp or the like is disposed in the fixing roller 23*a*.

The pressing roller 23*b* is obtained by, for example, forming a silicone rubber layer around a shaft and covering the surface of the silicone rubber layer with a release layer like a PFA tube. The pressing roller 23*b* is pressed against the fixing roller 23*a* at a predetermined pressing force so as to form a fixing nip portion N2 with a predetermined width.

The fixing roller 23*a* is rotated clockwise, as shown by the arrow in FIG. 2A, by a driving system (not shown) and the pressing roller 23*b* is rotated by the rotation of the fixing roller 23*a*. A thermistor 23*d*, which functions as a temperature sensor, is arranged so as to face the fixing roller 23*a*. The thermistor 23*d* is either in or out of contact with the fixing roller 23*a*. The fixing heater 23*c* receives electric power from a power supply unit (not shown) and accordingly the fixing roller 23*a* is heated by heat generated by the fixing heater 23*c*. The surface temperature of the fixing roller 23*a* is detected by the thermistor 23*d*, and the thus obtained temperature information is fed back to a controller. The controller controls the electric power supplied to the fixing heater 23*c* from the power supply unit so that the surface-temperature information fed back from the thermistor 23*d* is adjusted to a predetermined target temperature.

According to the present embodiment, the recording medium is conveyed along either a first conveying path 28 for causing the recording medium to pass through the second fixing unit 23 or a second conveying path 29 that is divided from the first conveying path 28 so that the recording medium does not pass through the second fixing unit 23. Switching between the first and second conveying paths 28 and 29 is performed by a conveying-path switching unit 30 (branching portion). When a monochrome image is formed or when it is not necessary to form a glossy image, the second conveying path 29 is selected so that the recording medium does not pass through the second fixing unit 23. When it is necessary to print a glossy image, the first conveying path 28 is selected so that the recording medium passes through the second fixing unit 23. Switching between the conveying paths can either be performed by the user or automatically.

The case in which the recording medium passes through both the first fixing unit 22 and the second fixing unit 23 will be described below.

First, a recording medium P guided from the transfer section to the fixing device A enters the fixing nip portion N1 of the first fixing unit 22 and is conveyed through the fixing nip portion N1. Accordingly, the unfixed toner image on the recording medium P is provisionally fixed by the nip pressure and heat applied from the fixing roller 22*a* (primary fixing). Then, the recording medium P is output from the first fixing unit 22 and is guided to the second fixing unit 23. The recording medium P enters the fixing nip portion N2 and is conveyed through the fixing nip portion N2. Accordingly, the provisionally fixed toner image on the recording medium P is subjected to an image-heating process by the nip pressure and heat applied from the fixing roller 23*a* (secondary fixing).

Thus, the image-heating process is performed twice, that is, in each of the primary and secondary fixing steps, and therefore stable fixing performance and a wide glossiness range can be achieved irrespective of the image data and the material type of the recording medium.

A sensor 27 serving as an image sensing member is disposed above the recording-medium conveying path 28 at a position between the first and second fixing units 22 and 23 to detect the state of the image on the recording medium output from the first fixing unit 22. The controller controls a fixing condition of the second fixing unit 23 on the basis of the image state information obtained by the sensor 27. The sensor 27 and the control process for the fixing condition of the second fixing unit 23 will be described in more detail in section (4) below.

(3) Overall Control System of Image-Forming Apparatus

Figure 3:
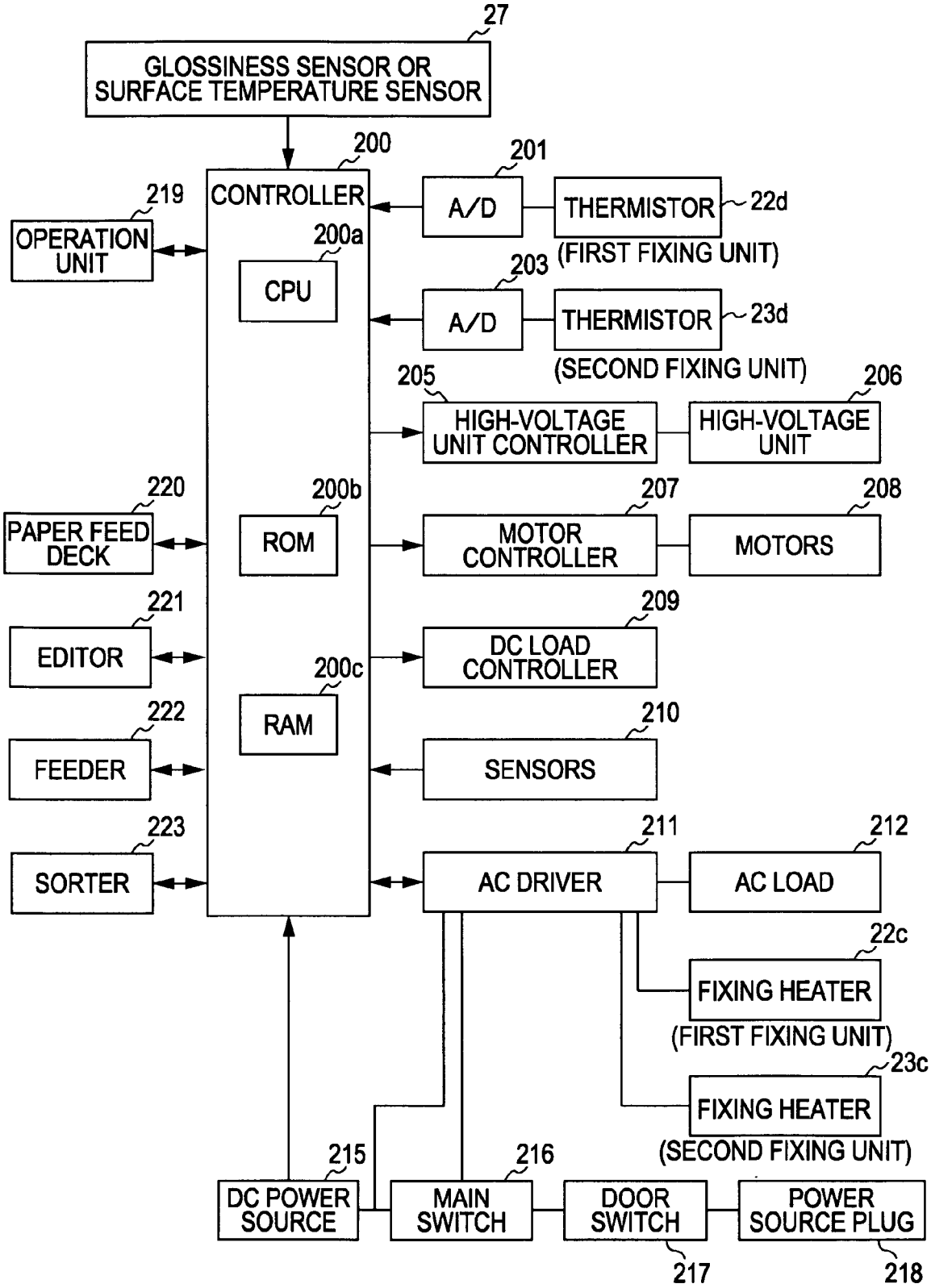
FIG. 3 is a block diagram of a control system of the image-forming apparatus.

FIG. 3 is a block diagram showing an example of the overall control system of the image-forming apparatus. Referring to FIG. 3, the control system includes a controller 200 having a central processing unit (CPU) 200*a*, a read only memory (ROM) 200*b*, a random access memory (RAM) 200*c*, etc. The controller 200 controls the overall copying sequence on the basis of a program stored in the ROM 200*b*.

An operation unit 219 includes a key input section including a copy-mode setting key, a number setting key for setting the number of copies to be made, a start key for starting the copying operation, a stop key for stopping the copying operation, a reset key for resetting the operation mode to normal, a glossiness-setting key for designating the glossiness of the output image (glossiness-setting means for selectively designating the glossiness of the output image). In addition, the operation unit 219 also includes a display section, such as a light-emitting diode (LED) and a liquid crystal panel, that displays the setting of the operation mode.

The thermistor 22*d* detects the surface temperature of the fixing roller 22*a* included in the first fixing unit 22. The detected surface temperature is subjected to analog-to-digital (A/D) conversion by an A/D converter 201 and is then input to the controller 200. The controller 200 controls the surface temperature of the fixing roller 22*a* included in the first fixing unit 22 at a predetermined value (set fixing temperature) on the basis of the detection value obtained by the thermistor 22*d*.

Similarly, the thermistor 23*d* detects the surface temperature of the fixing roller 23*a* included in the second fixing unit 23. The detected surface temperature is subjected to analog-to-digital (A/D) conversion by an A/D converter 203 and is then input to the controller 200. The controller 200 controls the surface temperature of the fixing roller 23*a* included in the second fixing unit 23 at a predetermined value (set fixing temperature) on the basis of the detection value obtained by the thermistor 23*d*.

A high-voltage unit controller 205 controls a high-voltage unit 206 that applies a predetermined voltage to an electrification system including a primary electrifying unit and a transfer electrifying unit, a developing device, etc. in the main body 1 of the image-forming apparatus.

A motor controller 207 controls the operations of motors 208, such as stepping motors.

A DC load controller 209 controls the operations of the photosensitive drum 17, the fixing rollers 22*a* and 23*a* of the first and second fixing units 22 and 23, respectively, a fan, etc.

Sensors 210 are provided for detecting, for example, jamming of the recording medium, and detection signals obtained by the sensors 210 are input to the controller 200.

An AC driver 211 controls AC power supplied to an AC load 212 of a light source 7 and the fixing heaters 22*c* and 23*c* of the first and second fixing units 22 and 23, respectively. In addition, the AC driver 211 detects abnormal operations of the light source 7, the fixing heaters 22*c* and 23*c*, etc., and turns off a main switch 216, thus having a shut-off function.

A DC power source 215 supplies DC power to the controller 200, and AC power input from a power source plug 218 is input to the DC power source 215 via a door switch 217 and the main switch 216.

A paper feed deck 220 is a paper-feeding device used to increase the number of recording media that can be stacked, and is connected as an option.

An editor 221 is used to input position information in a process of trimming, masking, etc., and is connected as an option.

A feeder 222 is used when a document of a plurality of pages is set, and is connected as an option.

A sorter 223 is used for sorting the output recording media, and is connected as an option.

(4) Control Process of Fixing Unit A

Next, the control process of the fixing device A according to the present embodiment will be described.

Figure 2B:
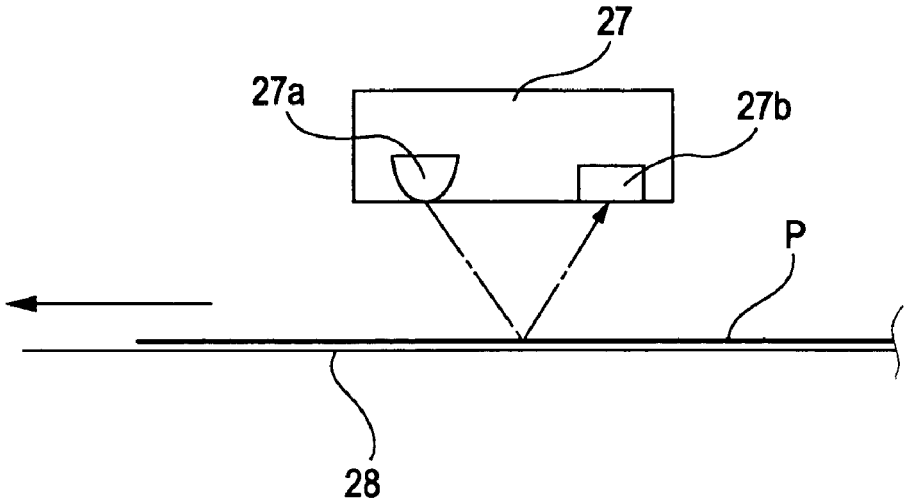
FIG. 2B illustrates an enlarged view of a glossiness sensor included in the fixing device.

As described above, the sensor 27 as an image sensing member is disposed above the recording-medium conveying path 28 at a position between the first and second fixing units 22 and 23 to detect the state of the image on the recording medium P output from the first fixing unit 22. Here, the sensor 27 is a glossiness sensor serving as a glossiness detecting member shown in FIG. 2B that functions as a glossiness-sensing member. In the glossiness sensor 27, light emitted from a light-emitting section 27*a* is reflected by the surface of the recording medium P and the reflected light is received by a light-receiving section 27*b*. Accordingly, the reflectance of the surface of the recording medium P, i.e., glossiness, is detected.

Figure 4:
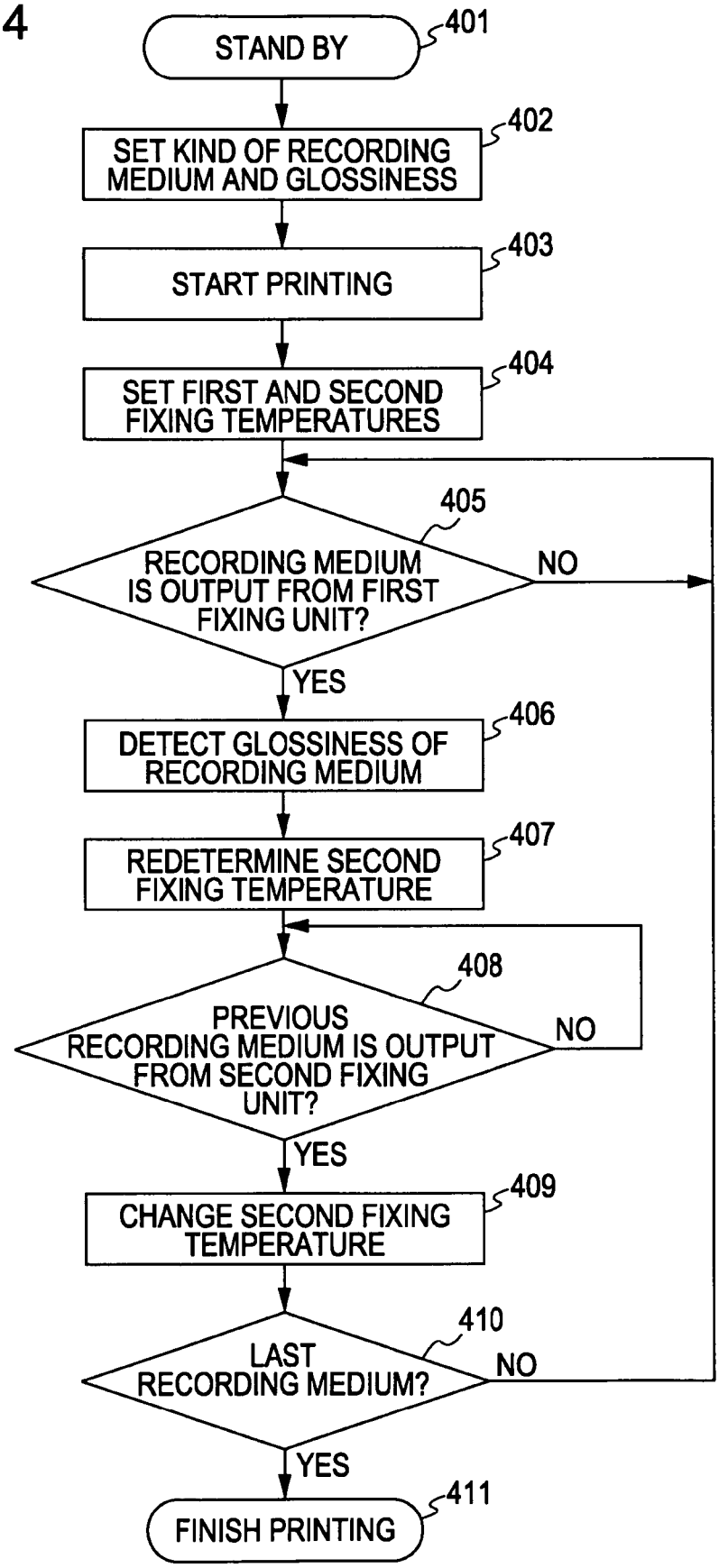
FIG. 4 is a control flowchart of the fixing device.

The control process for the fixing device A according to the present embodiment will be described with reference to a flowchart shown in FIG. 4.

First, the process begins in stand by state 401. Thereafter, the kind of recording medium (plain paper, cardboard paper, or glossy paper) and the level of glossiness of the image to be output are designated by the operation unit 219 or a printer driver (not shown) in step 402. Then, the print operation is started in step 403.

In the present embodiment, the glossiness can be set in five levels corresponding to 10%, 15%, 20%, 25%, and 30% based on the glossiness (reflectance) detected by the glossiness sensor 27. Alternatively, the glossiness may also be selected from, for example, high glossiness and low glossiness. In such a case, the high glossiness may be roughly set to 30% and the low glossiness may be roughly set to 10%.

When the print operation is started, the controller 200 refers to a correlation table shown in FIG. 5 representing the relationship among the kind of the recording medium, the glossiness (level of glossiness), the first fixing temperature, and the second fixing temperature. The correlation table shown in FIG. 5 is prepared in advance and stored in the ROM 200*b*. The controller 200 determines the fixing temperature of the first fixing unit 22 (first fixing temperature) and the fixing temperature of the second fixing unit 23 (second fixing temperature) on the basis of the designated kind of the recording medium and the designated glossiness using the correlation table (step 404).

When, for example, cardboard paper is designated as the kind of the recording medium P and 25% is selected as the level of glossiness, the controller 200 sets the first fixing temperature, that is, the fixing temperature of the first fixing unit 22, to 205° C. and the second fixing temperature, that is, the fixing temperature of the second fixing unit 23, to 200° C.

As described above, the toner image formed on the photosensitive drum 17 is transferred onto the recording medium P, and is then provisionally fixed on the recording medium P when the recording medium P passes through the fixing nip portion N1 of the first fixing unit 22 that is set to the above-mentioned first fixing temperature. Then, when it is determined that the leading edge of the recording medium P is output from the first fixing unit 22 in step 405, the glossiness sensor 27 starts detecting the glossiness of the surface of the image on the recording medium P conveyed from the first fixing unit 22 to the second fixing unit 23 along the recording-medium conveying path 28 in step 406. The glossiness information obtained by the glossiness sensor 27 is input to the controller 200.

Then, the controller 200 redetermines the second fixing temperature, that is, the fixing temperature of the second fixing unit 23, on the basis of the glossiness detected by the glossiness sensor 27.

Figure 6:
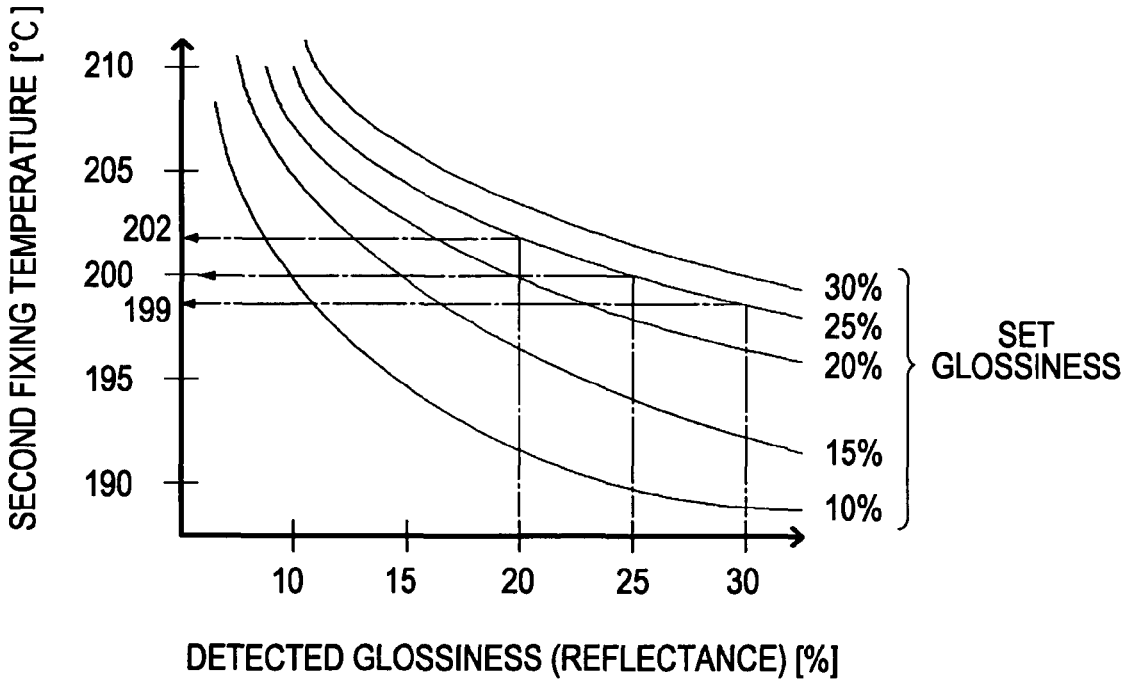
FIG. 6 is a diagram showing the relationship between the detection result of the glossiness sensor and the temperature of the second fixing unit.

More specifically, the controller 200 refers to correlation data (relational expressions) shown in FIG. 6 that represents the relationship among the detected glossiness, the second fixing temperature, and the designated glossiness for cardboard paper and that is prepared in advance and stored in the ROM 200*b*. When there is a difference between the designated glossiness and the actual glossiness detected by the sensor 27, the controller 200 redetermines the second fixing temperature so as to compensate for the difference on the basis of the correlation data (step 407). The temperature of the second fixing unit 23 is controlled at the redetermined second fixing temperature, and the recording medium P output from the first fixing unit 22 after primary fixing is subjected to the image-heating process performed by the second fixing unit 23.

In FIG. 6, the relationship between the detected glossiness and the second fixing temperature is represented as a curve for each of the designated glossiness levels. When, for example, 25% is selected as the glossiness of the output image and the detected glossiness is 20%, the fixing temperature of the second fixing unit 23 is increased from 200° C., which is the initial value, to 202° C.

Similarly, when the detected glossiness is 30%, the fixing temperature of the second fixing unit 23 is reduced from 200° C., which is the initial value, to 199° C.

Accordingly, the recording medium with the designated glossiness can be output from the second fixing unit 23.

In this example, the correlation data for cardboard paper shown in FIG. 6 is referred to since the kind of the recording medium is cardboard paper in the above-described example. However, the correlation data differs depending on the kind of the recording medium. Therefore, the ROM 200*b* also stores correlation data for plain paper and correlation data for glossy paper, which are obtained by performing preliminary experiments.

If the fixing temperature of the second fixing unit 23 is changed while a recording medium is being subjected to the fixing process, an image with uneven glossiness will be formed on the recording medium. Therefore, if a recording medium is being conveyed through the nip portion of the second fixing unit 23, the controller 200 waits until that recording medium is output from the second fixing unit 23 in step 408, and then changes the fixing temperature of the second fixing unit 23 in step 409.

The above-described steps are repeated until it is determined that the last recording medium is processed in step 410, and then the print operation is finished in step 411.

As described above, the glossiness is detected by the glossiness-sensing member while the recording medium is being conveyed between the first image-heating means and the second image-heating means. Therefore, the image-heating means can be adjusted at an early stage.

In addition, according to the present embodiment, the branching portion of the conveying path of the recording medium is positioned downstream of the glossiness-sensing member in the conveying direction of the recording medium. Therefore, the glossiness of the recording medium can be detected after the recording medium is output from the first fixing unit irrespective of whether or not the recording medium is conveyed to the second fixing unit 23.

Although the fixing temperature of the second fixing unit 23 is changed in the present embodiment, a similar effect can also be obtained when the fixing temperature of the first fixing unit 22 is changed by a similar method.

According to the above-described control sequence of the fixing device, the state of the recording medium (glossiness of the image on the recording medium in the present embodiment) is detected at a position between the first and second fixing units 22 and 23. Then, a control condition (target temperature in the present invention) of the second fixing unit 23 on the downstream is changed in accordance with the result of the fixing process performed by the first fixing unit 22 on the upstream. Therefore, even if the state of the recording medium output from the upstream first fixing unit 22 differs from the expected output because of the kind or condition of the recording medium, stable fixing and glossiness can still be achieved.

In addition, even when a desired amount of heat cannot be generated by the upstream first fixing unit 22 because of, for example, aging, the fixing condition of the downstream second fixing unit 23 can be corrected accordingly in real-time. Therefore, images with constant quality can be eventually obtained irrespective of the result of the fixing process performed by the upstream first fixing unit 22.

Second Embodiment

Figure 7:
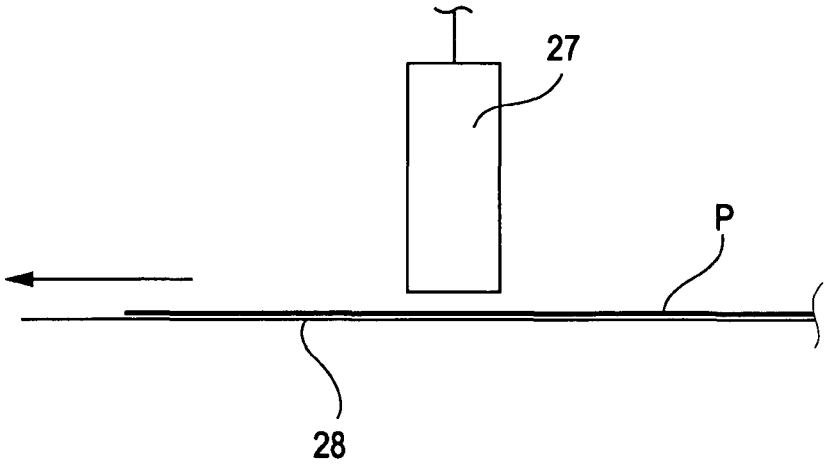
FIG. 7 illustrates a surface temperature sensor according to a second embodiment.

With reference to FIG. 7, in a second embodiment, a non-contact temperature sensor 27 that detects the surface temperature of an image formed on a recording medium P is provided as a sensing member for detecting the state of the image formed on the recording medium P that is output from a first fixing unit 22.

Figure 8A:
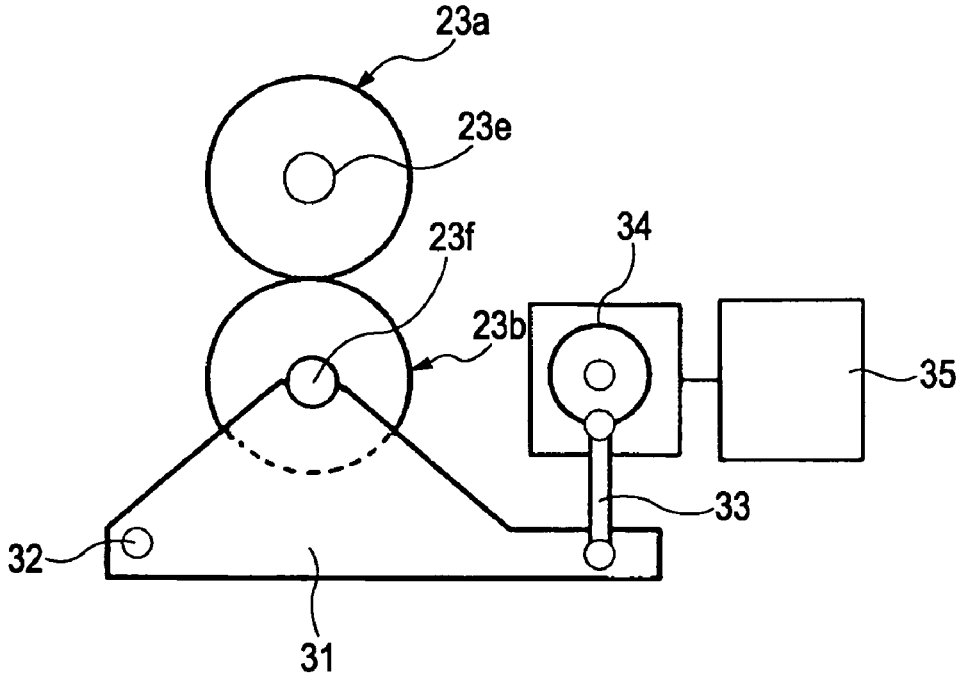
FIGS. 8A and 8B illustrate the schematic structure of a pressing-force-changing mechanism included in a second fixing unit according to the second embodiment.
Figure 8B:
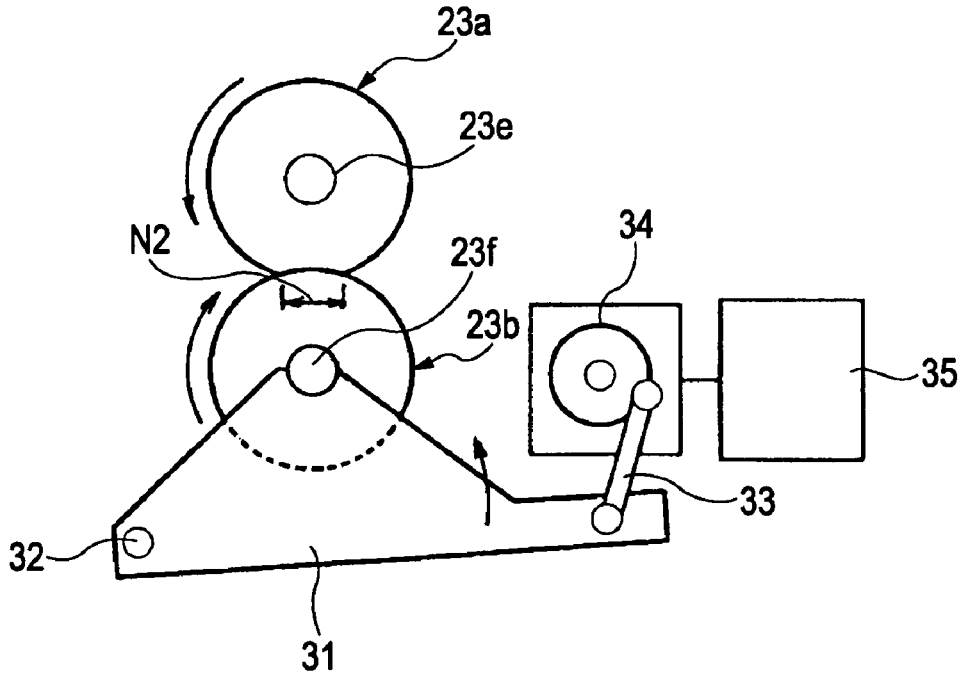

In addition, a second fixing unit 23 in which a pressing force applied in a fixing nip portion N2 thereof (hereafter called a second pressing force) can be varied is provided. More specifically, as shown in FIGS. 8A and 8B, a fixing roller 23*a* has a shaft portion 23*e* that is rotatably supported by bearings at both ends thereof, and the bearings are fixed on a frame (not shown) of the apparatus so that the fixing roller 23*a* cannot move. A pressing roller 23*b* positioned below the fixing roller 23*a* has a shaft portion 23*f* that is rotatably supported by pressing levers 31 at both ends thereof. Each of the pressing levers 31 is disposed on the frame of the apparatus such that the pressing lever 31 can pivot vertically around a supporting shaft 32. Each pressing member 31 is connected to a rotating member 34 with a link 33 at an end opposite to the end at which the supporting shaft 32 is provided. The rotating member 34 is rotatable in both forward and reverse directions by a drive motor 35. When the drive motor 35 rotates the rotating member 34 such that the pressing lever 31 is pulled upward around the supporting shaft 32, the pressing force (total pressure) at which the pressing roller 23*b* is pressed against the fixing roller 23*a* is increased. In reverse, when the drive motor 35 rotates the rotating member 34 such that the pressing lever 31 is moved downward, the pressing force at which the pressing roller 23*b* is pressed against the fixing roller 23*a* is reduced.

FIG. 8A shows the state in which the pressing lever 31 is moved downward to the limit and the pressing force at which the pressing roller 23*b* is pressed against the fixing roller 23*a* is substantially zero (the state in which the pressure is canceled). FIG. 8B shows the state in which the pressing lever 31 is pulled upward by a certain amount and the pressing roller 23*b* is in pressure contact with the fixing roller 23*a*.

Accordingly, the pressing force applied in the fixing nip portion N2 can be adjusted to a desired value by controlling the amount of rotation of the drive motor 35 such that the rotating member 34 stops at a certain rotational angle.

Figure 9:
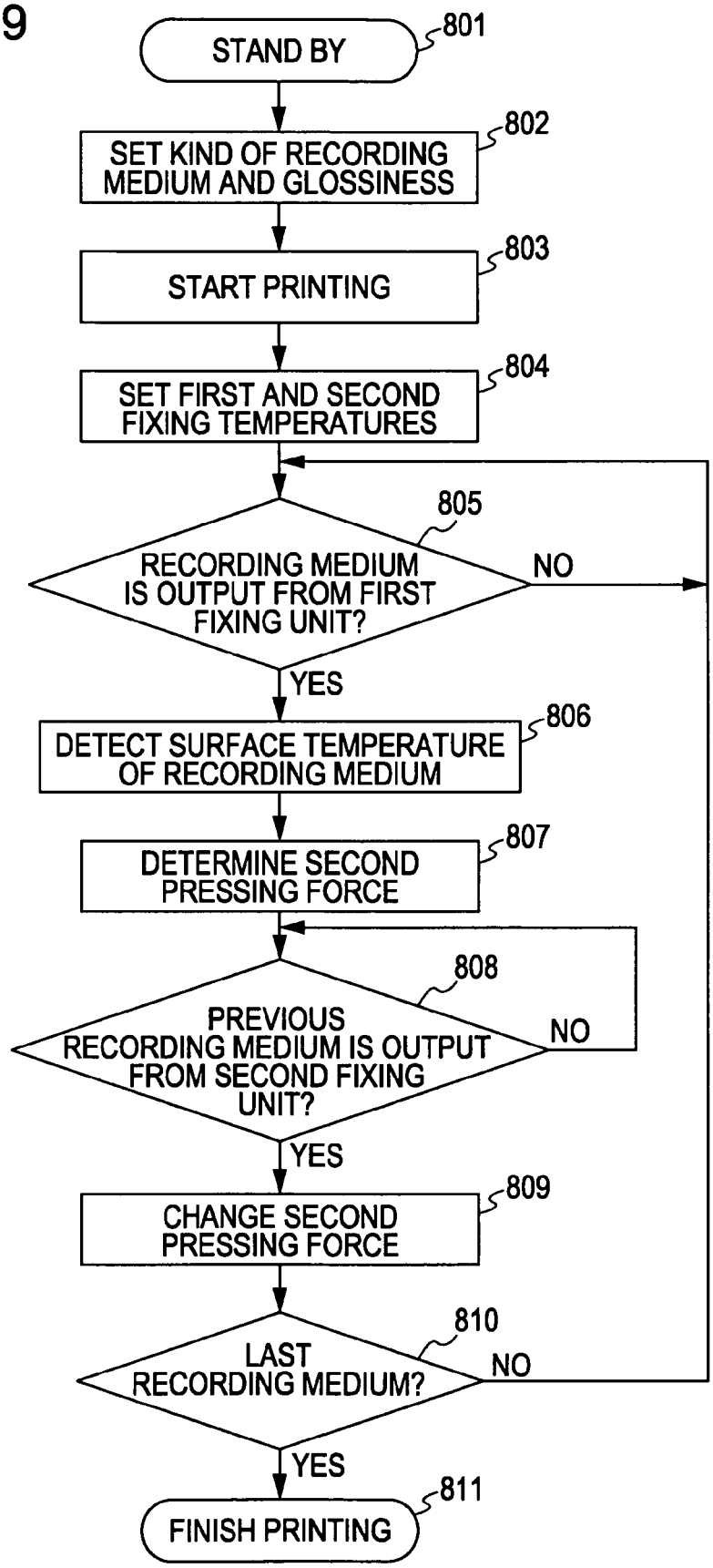
FIG. 9 is a control flowchart of a fixing device according to the second embodiment.

FIG. 9 is a flowchart of a control process of the fixing device according to the present embodiment. The control process will be described below with reference to the flowchart shown in FIG. 9.

First, as in the first embodiment, the process begins in stand by state 801, and thereafter the kind of the recording medium and the level of glossiness of the image to be output are designated by the operation unit 219 or a printer driver (not shown) in step 802. Then, the print operation is started in step 803.

When the print operation is started, the controller 200 refers to the correlation table shown in FIG. 5 that is stored in the ROM 200*b* and determines the fixing temperature of the first fixing unit 22 (first fixing temperature) and the fixing temperature of the second fixing unit 23 (second fixing temperature) on the basis of the designated kind of the recording medium and the designated glossiness (level of glossiness) that was set in step 804.

When, for example, plain paper is designated as the kind of the recording medium P and 15% is selected as the level of glossiness, the controller 200 sets the first fixing temperature, that is, the fixing temperature of the first fixing unit 22, to 175° C. and the second fixing temperature, that is, the fixing temperature of the second fixing unit 23, to 180° C.

As described above, the toner image formed on the photosensitive drum 17 is transferred onto the recording medium P, and is then provisionally fixed on the recording medium P when the recording medium P passes through the fixing nip portion N1 of the first fixing unit 22. Then, when it is determined that the leading edge of the recording medium P is output from the first fixing unit 22 in step 805, the surface temperature sensor 27, serving as a temperature detecting member, starts detecting the surface temperature of the recording medium P conveyed from the first fixing unit 22 to the second fixing unit 23 along the recording-medium conveying path 28 in step 806. The surface temperature of the recording medium P that is detected by the surface temperature sensor 27 is input to the controller 200.

In step 807, the controller 200 determines the second pressing force, that is, the pressing force applied in the fixing nip portion N2 of the second fixing unit 23 on the basis of the surface temperature of the recording medium detected by the surface temperature sensor 27 in step 806.

Figure 10:
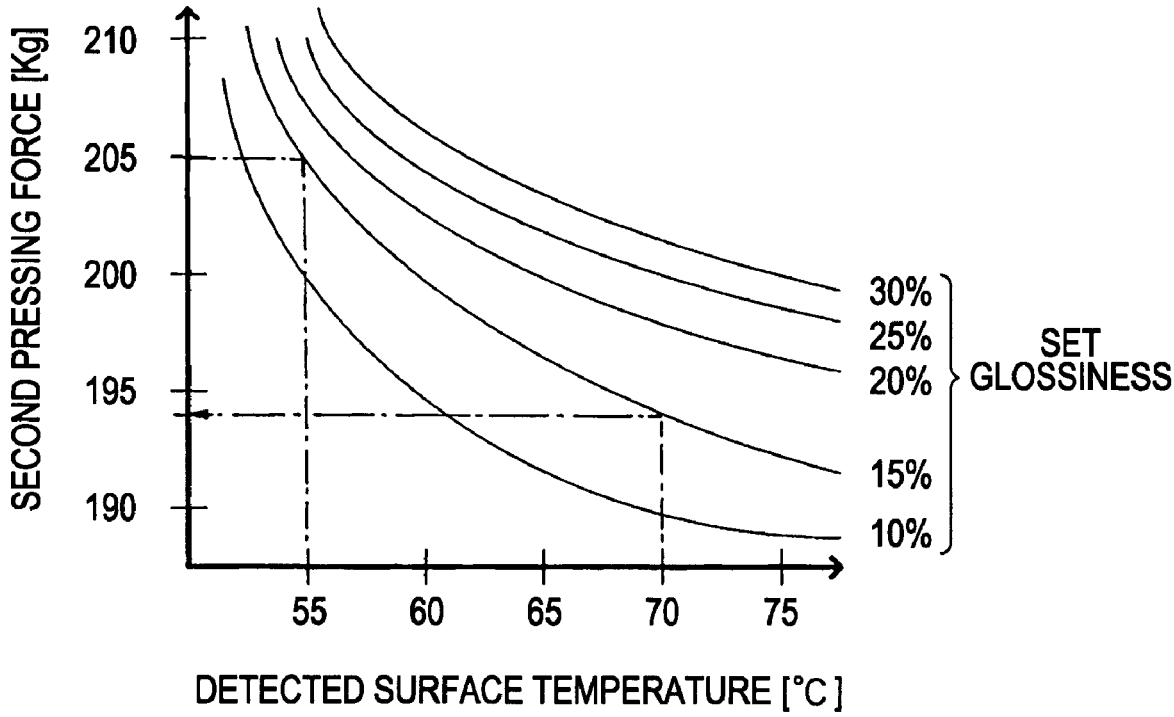
FIG. 10 is a diagram showing the relationship between the detection result of the surface temperature sensor and the pressing force of the second fixing unit according to the second embodiment.

More specifically, the controller 200 refers to correlation data (relational expressions) shown in FIG. 10 that represents the relationship among the detected surface temperature, the second pressing force, and the designated glossiness for plain paper. The correlation data is prepared in advance and stored in the ROM 200*b*. The controller 200 determines a suitable second pressing force on the basis of the relationship with the set glossiness (level of glossiness) and the surface temperature detected by the surface temperature sensor 27, and controls the amount of rotation of the drive motor 35 shown in FIGS. 8A and 8B so that the determined second pressing force is applied in the fixing nip portion N2 of the second fixing unit 23.

In FIG. 10, the relationship between the detected surface temperature of the recording medium and the second pressing force is represented as a curve for each of the designated glossiness levels. When, for example, 15% is selected as the glossiness of the output image and the detected surface temperature is 70° C., the second pressing force is reduced from 200 Kg (about 20 N), which is the initial value, to 194 Kg (about 19.8 N). Similarly, when the detected surface temperature is 55° C., the second pressing force is increased from 200 Kg (about 20 N), which is the initial value, to 205 Kg (about 21 N).

Accordingly, the recording medium with the designated glossiness can be output from the second fixing unit 23.

In this example, the correlation data for normal paper shown in FIG. 10 is referred to since the kind of the recording medium is plain paper in the above-described example. However, the correlation data differs depending on the kind of the recording medium. Therefore, the ROM 200*b* also stores correlation data for cardboard paper and correlation data for glossy paper, which correlation data are also prepared in advance.

If the second pressing force applied in the second fixing unit 23 is changed while a recording medium is being subjected to the fixing process, an image with uneven glossiness will be formed on the recording medium. Therefore, if a recording medium is being subjected to the fixing process in the second fixing unit 23, the controller 200 waits until that recording medium is output from the second fixing unit 23 in step 808, and then changes the second pressing force applied in the second fixing unit 23 in step 809.

The above-described steps are repeated until it is determined that the last recording medium is processed in step 810, and then the print operation is finished in step 811.

According to the above-described control sequence of the fixing device, the state of the recording medium (surface temperature of the recording medium in the present embodiment) is detected at a position between the first and second fixing units 22 and 23. Then, a control condition (pressing force in the present invention) of the second fixing unit 23 downstream of the first fixing unit 22 is changed in accordance with the result of the fixing process performed by the upstream first fixing unit 22. Therefore, even if the fixing state of the recording medium output from the upstream first fixing unit 22 differs from the expected fixing state because of the kind or condition of the recording medium, stable fixing state and glossiness can be achieved.

In addition, even when a desired amount of heat cannot be generated by the upstream first fixing unit 22 because of, for example, aging, the fixing condition of the downstream second fixing unit 23 can be corrected accordingly in real-time. Therefore, images with constant quality can be eventually obtained irrespective of the result of the fixing process performed by the upstream first fixing unit 22.

Third Embodiment

Figure 11:
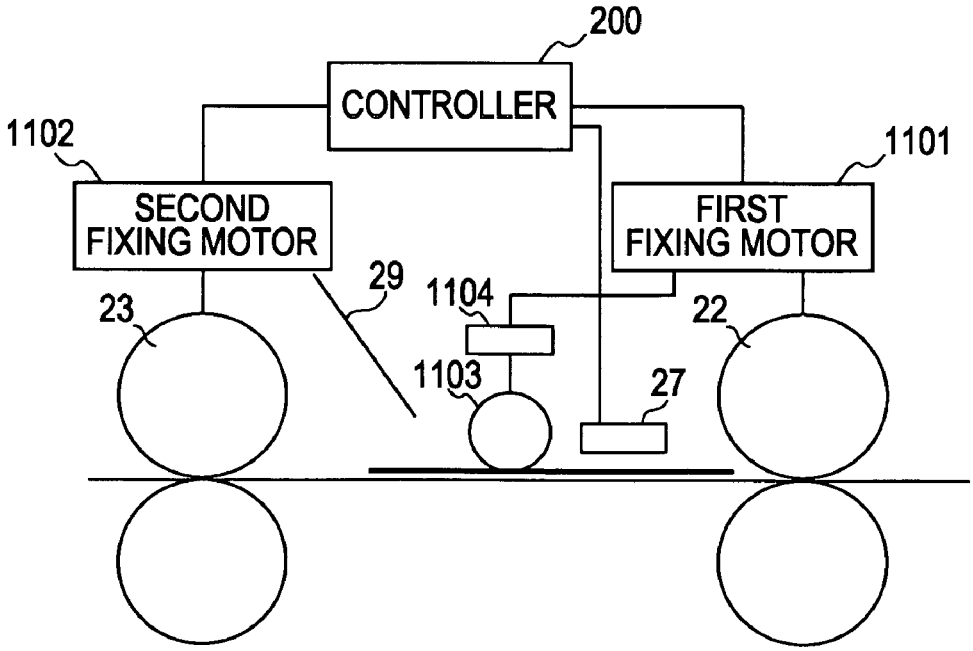
FIG. 11 illustrates a schematic diagram of a fixing device according to a third embodiment.

FIG. 11 illustrates a schematic diagram of an image-heating device according to a third embodiment. Referring to FIG. 11, a first fixing unit 22 includes a first image-heating member driven by a first fixing motor 1101 and a second fixing unit 23 includes a second image-heating member driven by a second fixing motor 1102. A conveying roller 1103 serves as a roller for conveying the recording medium between the first and second fixing units 22 and 23 and is driven by the first fixing motor 1101 together with the first fixing unit 22. The first fixing motor 1101 and the conveying roller 1103 are connected to each other with a one-way clutch 1104, so that the recording medium can be pulled toward the second fixing unit 23 at a speed different from the rotational speed of the conveying roller 1103. Reference numeral 27 denotes a glossiness detecting member similar to that described in the first embodiment. The above-described components are controlled by the controller 200.

In the present embodiment, the glossiness of the recording medium is adjusted by controlling the speed of the second fixing motor 1102 on the basis of the glossiness detected by the sensor 27 so as to change the time required for the recording medium to pass through the second fixing unit 23. The speed of the first fixing motor 1101 is not controlled dynamically, and is simply switched between equal speed, half speed, and quarter speed depending on the kind of the recording medium. However, the speed of the second fixing motor 1102 is controlled such that it is always higher than the speed of the first fixing motor 1101. This is because the recording medium can be normally conveyed due to the one-way clutch 1104 as long as the recording medium is pulled by the second fixing unit 23 but cannot be normally conveyed when the recording medium is pushed by the first fixing unit 22. Reference numeral 29 denotes a part of a conveying path selected when the recording medium does not pass through the second fixing unit 23.

Figure 12:
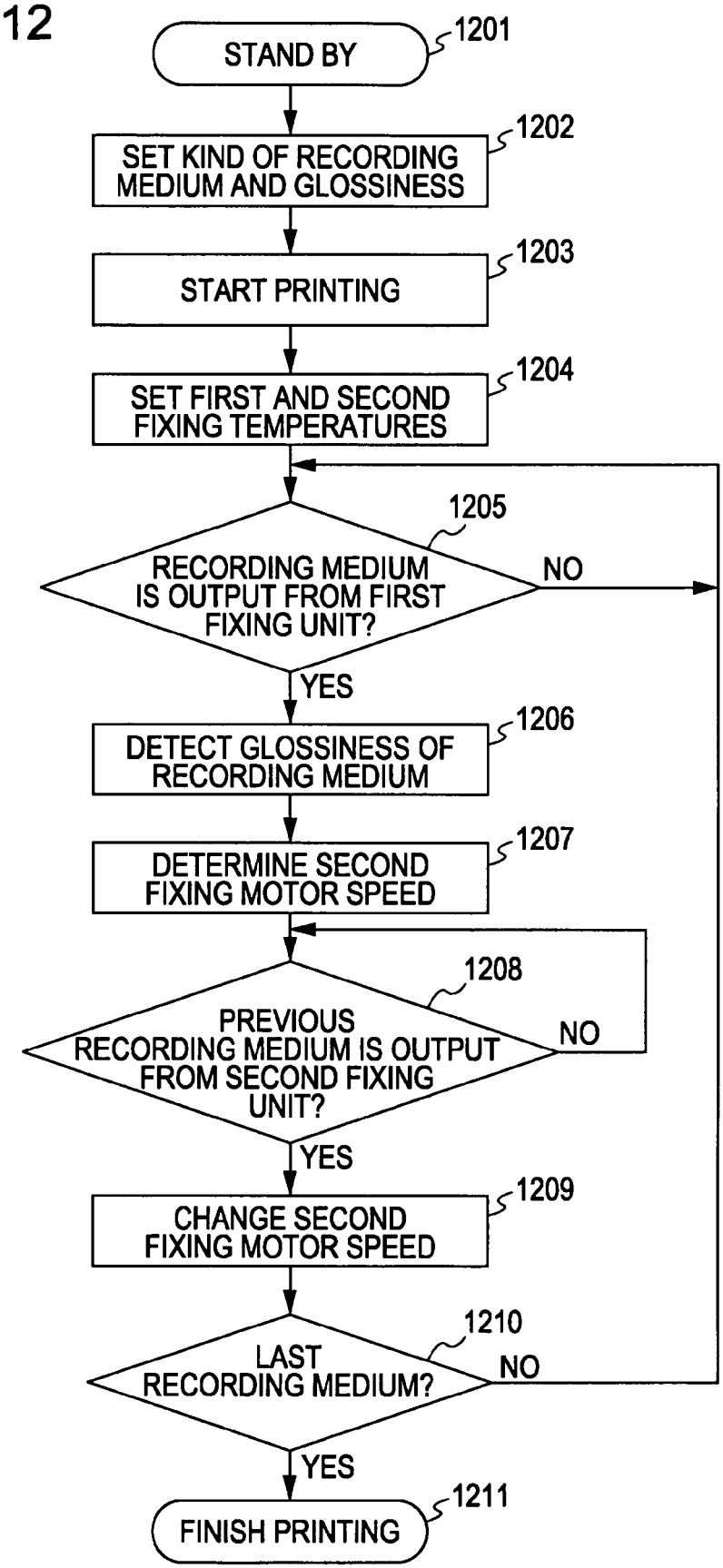
FIG. 12 is a control flowchart of the fixing device according to the third embodiment.

The control process will be described below with reference to the flowchart shown in FIG. 12.

First, similar to the first embodiment, after standby state 1201, the kind of the recording medium and the level of glossiness of the image to be output are designated by the operation unit 219 or a printer driver (not shown) in step 1202. Then, the print operation is started in step 1203.

When the print operation is started, the controller 200 refers to the correlation table shown in FIG. 5 that is stored in the ROM 200*b* and in step 1204 determines and sets the fixing temperature of the first fixing unit 22 (first fixing temperature) and the fixing temperature of the second fixing unit 23 (second fixing temperature) on the basis of the designated kind of the recording medium and the designated glossiness (level of glossiness).

As described above, the toner image formed on the photosensitive drum 17 is transferred onto the recording medium P, and is then provisionally fixed on the recording medium P when the recording medium P passes through the fixing nip portion N1 of the first fixing unit 22. Then, when it is determined that the leading edge of the recording medium P is output from the first fixing unit 22 in step 1205, the glossiness sensor 27 starts detecting the glossiness of the surface of the image on the recording medium P conveyed from the first fixing unit 22 to the second fixing unit 23 along the recording-medium conveying path 28 in step 1206. The glossiness information obtained by the glossiness sensor 27 is input to the controller 200.

The controller 200 determines the speed at the second fixing unit 23 on the basis of the glossiness detected by the glossiness sensor 27 in step 1207. When V1 is the conveying speed for the recording medium P at the first fixing unit 22, X is the set glossiness, Y is the detected glossiness, and k is a speed coefficient, the conveying speed V2 for the recording medium P at the second fixing unit 23 can be obtained as follows:

$$V2=V1\times k(X-Y)$$

The speed coefficient k is obtained by preliminary experiments, and is set to 1.01 in the present embodiment. Although there is a possibility that a negative value will be obtained as V2 depending on the detected glossiness, the speed will not be changed in such a case.

If the speed at the second fixing unit 23 is changed while a recording medium is being subjected to the fixing process, the image cannot be output normally. Therefore, if a recording medium is being subjected to the fixing process in the second fixing unit 23, the controller 200 waits until that recording medium is output from the second fixing unit 23 in step 1208, and then changes the speed at the second fixing unit 23 in step 1209.

The above-described steps are repeated until it is determined that the last recording medium is processed in step 1210, and then the print operation is finished in step 1211.

According to the above-described control sequence of the fixing device, the state of the recording medium (glossiness of the recording medium in the present embodiment) is detected at a position between the first and second fixing units 22 and 23. Then, a control condition (speed in the present invention) at the downstream second fixing unit 23 is changed in accordance with the result of the fixing process performed by the upstream first fixing unit 22. Therefore, even if the fixing state of the recording medium output from the upstream first fixing unit 22 differs from the prediction because of the kind or condition of the recording medium, stable fixing state and glossiness can be achieved eventually.

In addition, even when a desired amount of heat cannot be generated by the upstream first fixing unit 22 because of, for example, aging, the fixing condition of the downstream second fixing unit 23 can be corrected accordingly in real-time. Therefore, images with constant quality can be eventually obtained irrespective of the result of the fixing process performed by the upstream first fixing unit 22.

Others

The present invention is not limited to the above-described first to third embodiments. For example, the glossiness of the recording medium may be detected after the recording medium is output from the first fixing unit and the pressing force of the second fixing unit may be changed in accordance with the result of detection and the set glossiness. Alternatively, the surface temperature of the recording medium may be detected after the recording medium is output from the first fixing unit and the temperature of the second fixing unit may be changed in accordance with the result of detection and the set glossiness. Also in these cases, effects similar to the above-described effects can be obtained.

More specifically, all of the combinations are possible in which one or both of the surface reflectance and the surface temperature of the recording medium are detected as items representing the state of the recording medium after the recording medium is output from the first fixing unit and one or more of the temperature, the pressure, and the speed are changed as control items of the second fixing unit.

In addition, when a belt-type fixing unit in which the length of the fixing nip portion in the conveying direction of the recording medium can be changed is used as the second fixing unit, a fixing length (heating length) of the recording medium may also be set as a control item of the second fixing unit.

The fixing units included in the fixing device having a tandem structure are not limited to those of the heat roller type. For example, film-type fixing units including heaters for heating the image on the recording medium by applying heat via films may also be used. In addition, the number of fixing units is not limited to two, and three or more fixing units may also be included.

While the present invention has been described with reference to exemplary embodiments, it is to be understood that the invention is not limited to the disclosed exemplary embodiments.

This application claims the benefit of Japanese Application No. 2005-106352 filed Apr. 1, 2005, which is hereby incorporated by reference herein in its entirety.

What is claimed is:

1. An image forming apparatus comprising:

an image forming device configured to form a toner image on a sheet;

a first image heating device configured to heat the toner image formed on the sheet at a first nip;

a second image heating device configured to heat the toner image on the sheet, heated by said first image heating device, at a second nip which is different from the first nip;

a first path for conveyance of the sheet which is heated by said first image heating device through said second image heating device toward the outside of said apparatus;

a second path, branched from said first path, for conveying the sheet heated by said first image heating device without being conveyed through said second image heating device, toward the outside of said apparatus;

a bifurcation portion at which said second path branches from said first path;

a detector, disposed at a position between said first image heating device and said second image heating device, configured to detect a glossiness of the toner image on the sheet heated by said first image heating device; and a controller configured to control an operating condition of said second image heating device based on the detected glossiness of the toner image on the sheet heated by said first image heating device so that the glossiness of the toner image on the sheet becomes a target glossiness, wherein said detector is disposed at a position upstream of said bifurcation portion and downstream of said first image heating device in a conveying direction of the sheet.

2. The image forming apparatus according to claim 1, wherein said second image heating device includes a pair of rotating members configured to form the second nip therebetween, and wherein said controller controls a pressure between said pair of rotating members based on the output of said detector.

3. The image forming apparatus according to claim 1, wherein said second image heating device includes a pair of rotating members configured to form the second nip therebetween, and wherein said controller controls a rotational speed of said pair of rotating members based on the output of said detector.

4. The image forming apparatus according to claim 1, wherein said controller controls an image heating temperature of said second image heating device based on the output of said detector.

5. The image forming apparatus according to claim 1, further comprising an operating portion configured to set the target glossiness by an operator.

6. The image forming apparatus according to claim 1, wherein said detector includes a light emitting element configured to emit a light toward the toner image on the sheet and a light receiving element configured to receive a light reflected by the toner image on the sheet to detect the glossiness.

7. The image forming apparatus according to claim 1, wherein said detector includes a temperature detecting element configured to detect a temperature of the sheet to detect the glossiness.

8. The image forming apparatus according to claim 1, wherein said first image heating device includes a pair of rotating members configured to form the first nip therebetween.

* * * * *